US007976049B2

(12) United States Patent
Chiu

(10) Patent No.: US 7,976,049 B2
(45) Date of Patent: Jul. 12, 2011

(54) ASSEMBLY AND POSITIONING MECHANISM FOR WHEELCHAIR AND AUXILIARY OPERATING LEVER

(75) Inventor: Chien-Liang Chiu, Taipei (TW)

(73) Assignee: Wu's Tech Co., Ltd., Hsinchu (TW)

( * ) Notice: Subject to any disclaimer, the term of this patent is extended or adjusted under 35 U.S.C. 154(b) by 0 days.

(21) Appl. No.: 12/612,813

(22) Filed: Nov. 5, 2009

(65) Prior Publication Data

US 2011/0101642 A1 May 5, 2011

(51) Int. Cl.
*A61G 5/04* (2006.01)
*A61G 5/10* (2006.01)

(52) U.S. Cl. ..... 280/304.1; 180/13

(58) Field of Classification Search ..... 280/304.1, 280/250.1; 180/11, 12, 13
See application file for complete search history.

(56) References Cited

U.S. PATENT DOCUMENTS 4,720,117 A * 1/1988 Hay ..... 280/250
5,228,711 A * 7/1993 Summers ..... 280/304.1
5,291,959 A * 3/1994 Malblanc ..... 180/11
5,476,241 A * 12/1995 Helman ..... 248/286.1
5,494,126 A * 2/1996 Meeker ..... 180/13
5,651,422 A * 7/1997 Casali ..... 180/13
6,669,222 B1 * 12/2003 Barrett et al. ..... 280/304.1
7,216,728 B2 * 5/2007 Huang et al. ..... 180/13
2008/0115982 A1 * 5/2008 Lin ..... 180/13
2009/0008902 A1 * 1/2009 Kylstra et al. ..... 280/304.1

* cited by examiner

*Primary Examiner* — Paul N Dickson
*Assistant Examiner* — Wesley Potter
(74) *Attorney, Agent, or Firm* — Egbert Law Offices PLLC

(57) ABSTRACT

An assembly and positioning mechanism for wheelchair and auxiliary operating lever. The assembly and positioning mechanism has a swinging angular adjustment seat and a liftable pivoting seat of operating lever. The angular adjustment seat has an assembly side of locating rack and an assembly side of pivoting seat. The assembly side of locating rack is pivoted onto the locating rack via an adjuster, and the angular adjustment seat can swing rotarily. The pivoting seat of operating lever consists of a connecting side and a mating side of operating lever. The pivoting seat of operating lever can move vertically via a limiting portion. The mating side of operating lever is fitted with a limiting rabbet and a guide opening extended in an outward-dipping state. The mechanism can swing and also shift vertically, making it possible to control the guide opening of the mating side of operating lever for outward-dipping extension.

5 Claims, 5 Drawing Sheets

ASSEMBLY AND POSITIONING MECHANISM FOR WHEELCHAIR AND AUXILIARY OPERATING LEVER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an assembly and positioning mechanism for a wheelchair and auxiliary operating lever. More particularly, the present invention relates to an innovative one which can be adjusted according to the size of the wheelchair carriage.

2. Description of Related Art Including Information Disclosed Under 37 CFR 1.97 and 37 CFR 1.98

The wheelchairs are generally pushed manually by the users or the others with much burdens or efforts.

For this reason, an auxiliary power structure that can be mounted onto existing manual wheelchairs has been developed, enabling the manual wheelchairs to walk autonomously. Yet, an assembly and positioning mechanism is required if the handle of the typical auxiliary power structure is to be assembled at the front side of the wheelchair. The configuration of the assembly and positioning mechanism has some shortcomings. For example, the assembly and positioning mechanism cannot be adjusted comprehensively in line with different wheelchair carriages, leading to limited assembly space.

Thus, to overcome the aforementioned problems of the prior art, it would be an advancement if the art to provide an improved structure that can significantly improve the efficacy.

Therefore, the inventor has provided the present invention of practicability after deliberate experimentation and evaluation based on years of experience in the production and development of related products.

BRIEF SUMMARY OF THE INVENTION

The enhanced efficacy of the present invention is as follows:

Based on the unique structural configuration of the present invention that the "assembly and positioning mechanism" mainly comprises an angular adjustment seat and a pivoting seat of operating lever, as the angular adjustment seat can swing rotarily, and the pivoting seat of operating lever can shift vertically, so that the limiting rabbet of the assembly and positioning mechanism can be set into outward-dipping extension state with a preset distance from the ground, making it possible to adjust the assembly and positioning mechanism and meet the different sizes of wheelchair carriages with an improved applicability.

The improvements brought about by this invention are as follows:

As the upper and lower cross rods of the locating rack are configured in a way that inner and external tubes are sleeved together, and the tension member is used to control the adjustment and positioning state of the upper and lower cross rods, thus flexibly adjusting the length of the upper and lower cross rods in line with the size of the wheelchair carriages.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
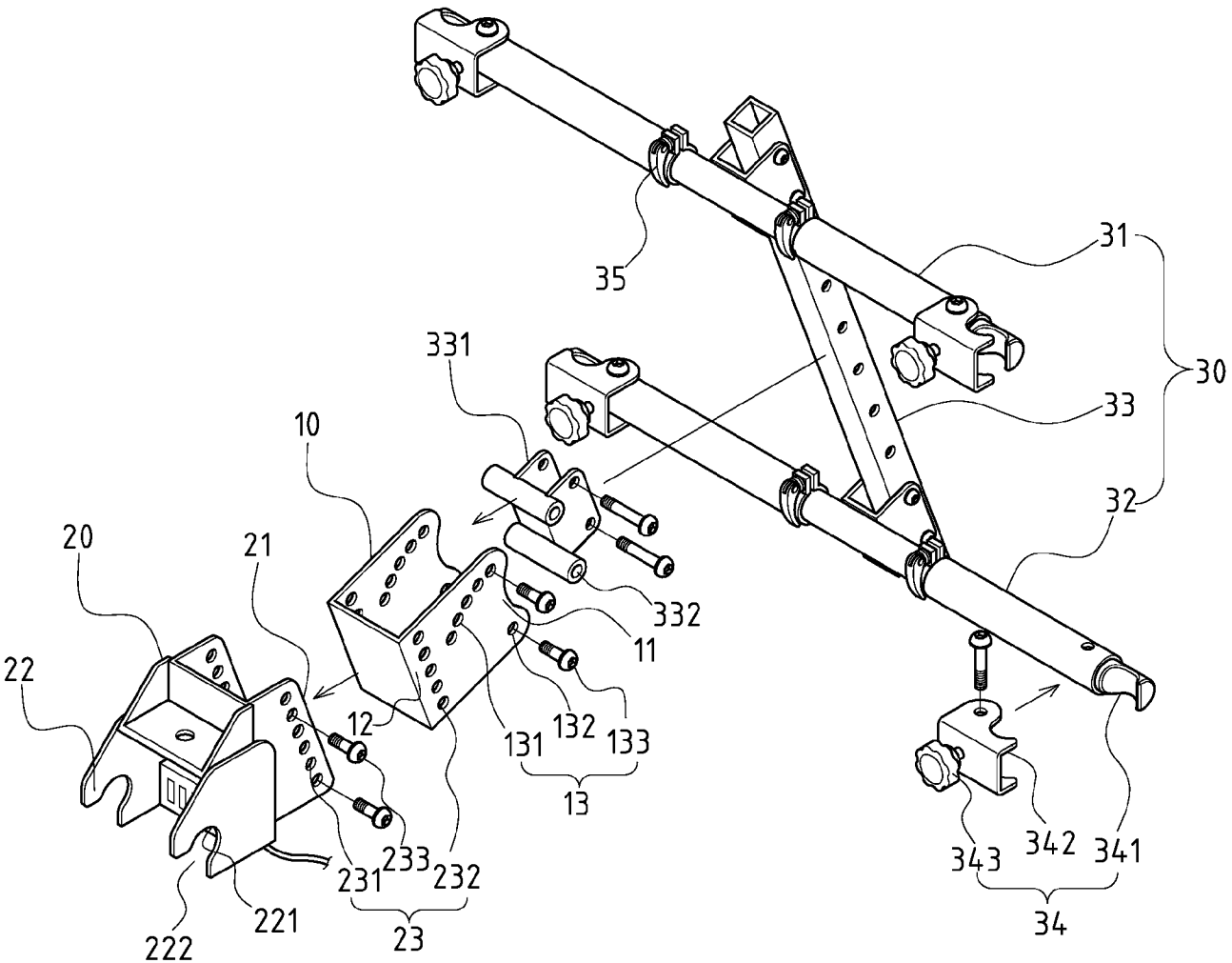
FIG. 1 shows an exploded perspective view of the preferred embodiment of the present invention.
Figure 2:
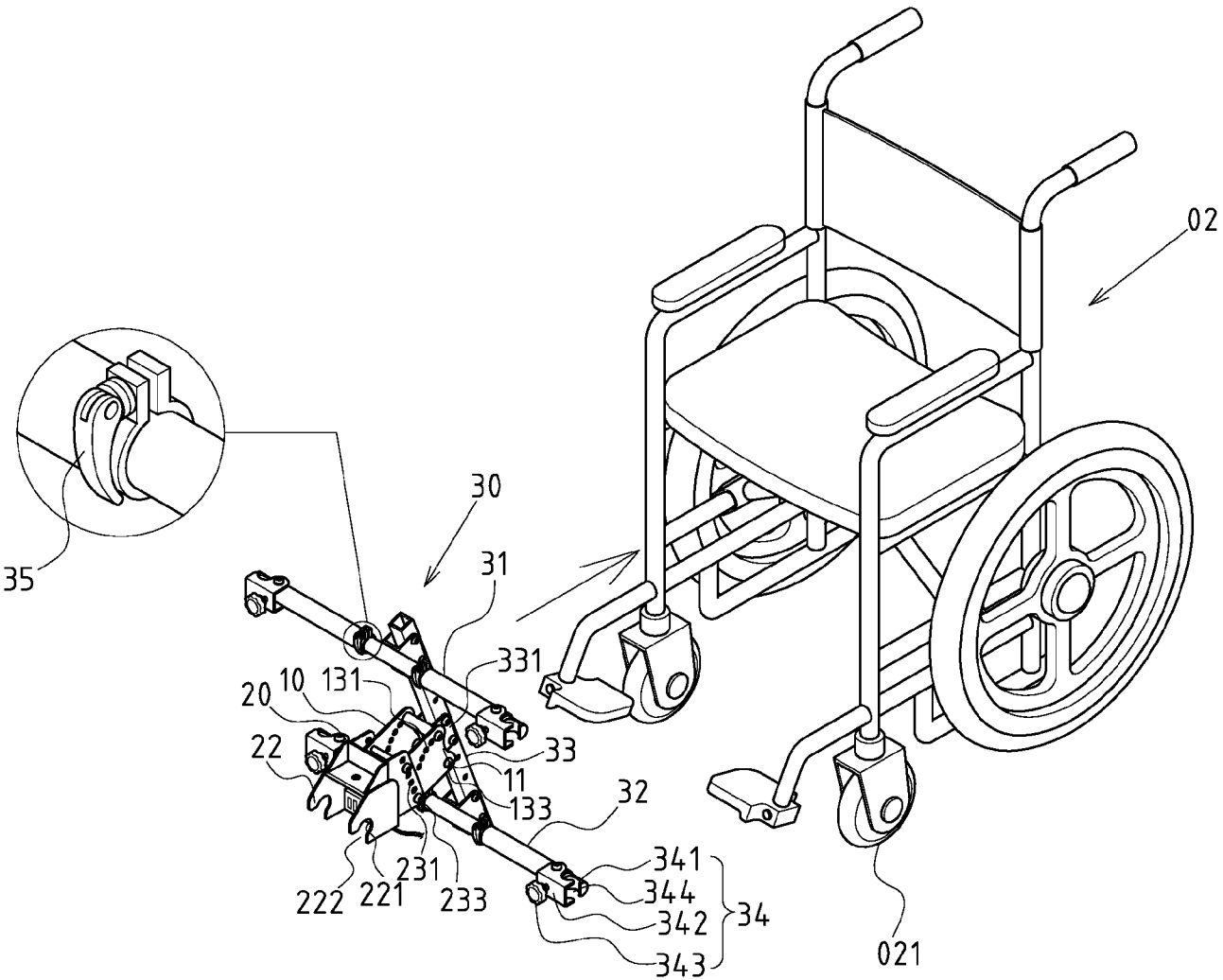
FIG. 2 shows a schematic view of the preferred embodiment of the present invention.
Figure 4:
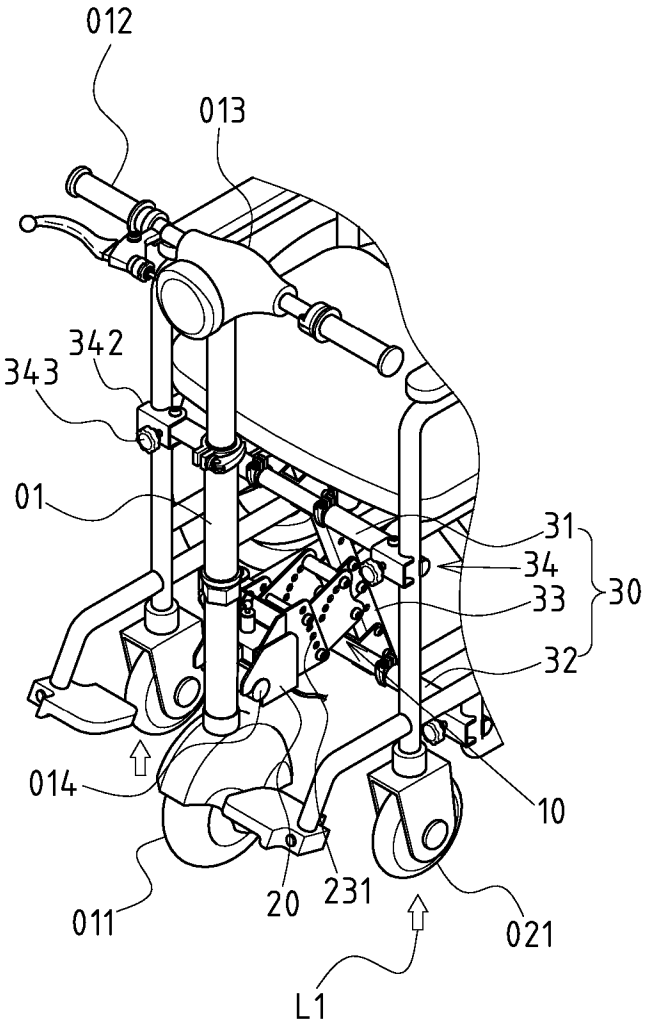
FIG. 4 shows a schematic view of the present invention that the operating lever is assembled onto the assembly and positioning mechanism enabling the front wheel of the wheelchair to be lifted off.
Figure 3:
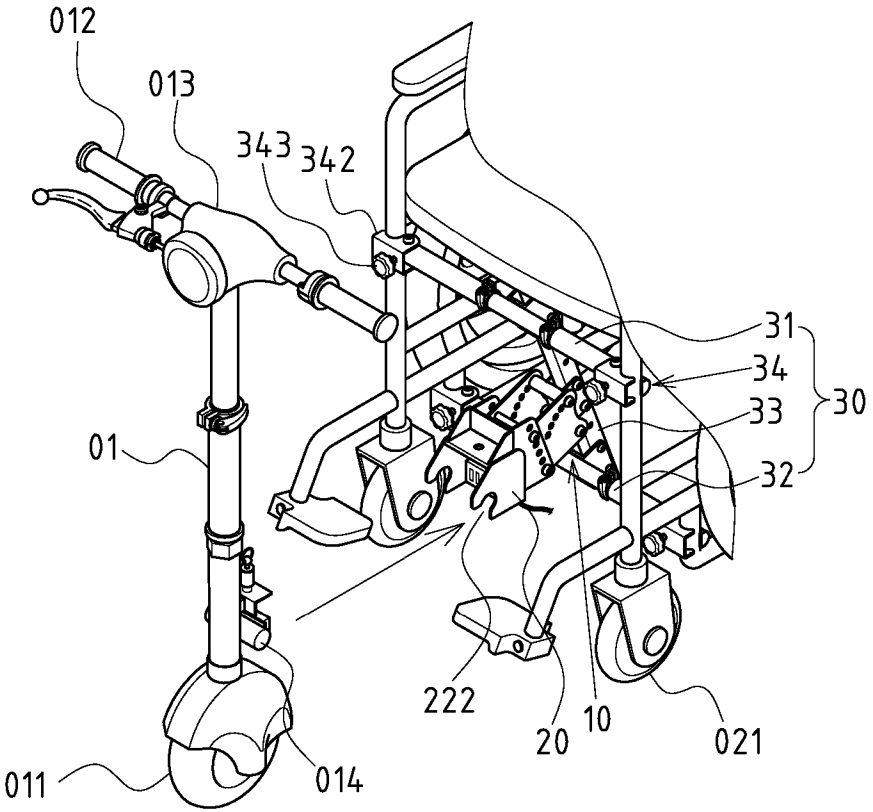
FIG. 3 shows a schematic view of the operating lever and assembly and positioning mechanism of the present invention.

FIGS. 1-4 depict preferred embodiments of an assembly and positioning mechanism for the wheelchair and auxiliary operating lever of the present invention provided for only explanatory objective for patent claims. Said auxiliary operating lever 01 can be mounted onto an existing manual wheelchair 02, and a drive unit is used to drive the wheelchair 02, turning it into a self-controlled walking mechanism. A locating rack 30 is erected at the front side of the carriage of the wheelchair 02, so that the auxiliary operating lever 01 can be mounted onto the carriage via an assembly and positioning mechanism. An auxiliary steering wheel 011 is placed at the bottom of the auxiliary operating lever 01, and a control pedestal 013 with a cross handle 012 arranged at the top.

The assembly and positioning mechanism comprises a swinging angular adjustment seat 10, which is provided with an assembly side of locating rack 11 and an assembly side of pivoting seat 12 arranged at interval. The assembly side of locating rack 11 is pivoted onto the locating rack 30 via an adjuster 13, and the angular adjustment seat 10 can swing rotarily, thus controlling the adjustment and positioning state of the angular adjustment seat 10.

The assembly and positioning mechanism also includes a liftable pivoting seat of operating lever 20, which contains a connecting side 21 and a mating side of operating lever 22. The connecting side 21 is aligned with the assembly side of pivoting seat 12 specific to the angular adjustment seat 10, and then the pivoting seat of operating lever 20 is mated with the angular adjustment seat 10 via a limiting portion 23, making the pivoting seat of operating lever 20 vertically moveable. The mating side of operating lever 22 is provided with a limiting rabbet 221 of mouthed profile. The limiting rabbet 221 is provided with a guide opening 222 extended in an outward-dipping state. The mating side of operating lever 22 enables assembly of the auxiliary operating lever 01.

With this configuration, the assembly and positioning mechanism can be used to control the guide opening 222 of the mating side of operating lever 22 in an outward-dipping state. Moreover, the snapping rod 014 of the operating lever 01 is obliquely embedded upwards into the limiting rabbet 221. With this embedding state, the locating rack 30 drives the front wheel 021 of the wheelchair 02 to be lifted off, so as to rotate easily the direction of the wheelchair 02.

The locating rack 30 of a I-shaped profile forms an upper cross rod 31, a lower cross rod 32 and a vertical rod 33; at the ends of upper and lower cross rods 31, 32, a retaining seat 34 is arranged for mating with the carriage of the wheelchair 02. The vertical rod 33 is fitted with a connecting member 331, which is available with screwing holes 332 at interval. The adjuster 13 of the angular adjustment seat 10 consists of a plurality of assembly holes 131 arranged transversely at top of the assembly side of locating rack, as well as a fixed through-hole 132 at bottom of the assembly side of locating rack 11. The assembly hole 131 and the fixed through-hole 132 are separately threaded via a bolt 133 into the screwing hole 332 of the connecting member 331, so that the angular adjustment seat 10 can take the fixed through-hole 132 as a pivot to pass through different assembly holes 131 via the bolt 133, enabling adjustment and limitation of the angular adjustment seat 10.

Figure 7:
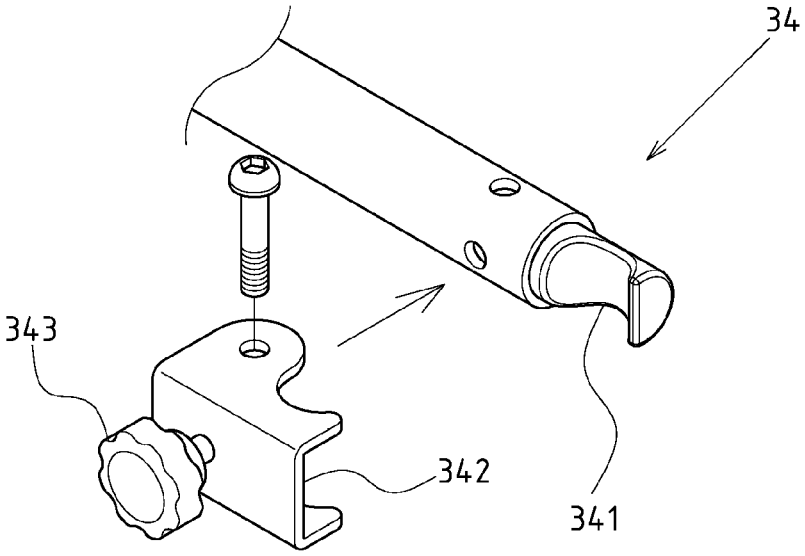
FIG. 7 shows an exploded view of the retaining seat of the present invention.
Figure 8:
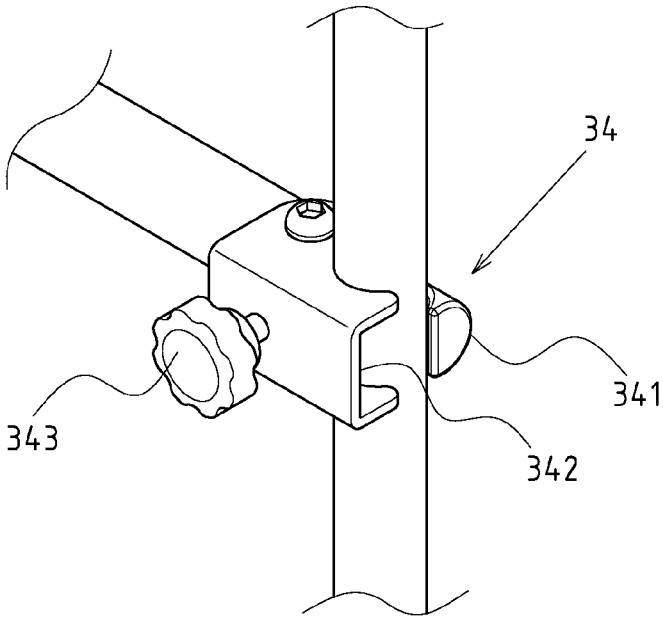
FIG. 8 shows a schematic view of the present invention that the retaining seat retains securely the carriage of the wheelchair.

The retaining seat 34 of the locating rack 30 has a fixed end 341, a moveable end 342 and a drive member 343 controlling the shift of the moveable end 342. A retaining space 344 is defined between the fixed end 341 and the moveable end 342, allowing for permanent retaining onto the carriage. The drive member 343 is comprised of a lever and a rotary button shifting spirally. Referring to FIGS. 7 and 8, the retaining seat 34 can retain securely the carriage of the wheelchair 02.

The upper and lower cross rods 31, 32 of the locating rack 30 are configured in a way that inner and external tubes are sleeved together so as to flexibly adjust the length of the upper and lower cross rods 31, 32. Moreover, the upper and lower cross rods 31, 32 are fitted with a tension member 35 so as to control the adjustment and positioning state of the upper and lower cross rods 31, 32; the adjustment of the upper and lower cross rods 31, 32 of the locating rack 30 can be made to meet different sizes of carriages of the wheelchair 02 (as disclosed in FIG. 2).

Of which, the limiting portion 23 consists of a plurality of through-holes 231 and locating screw holes 232 and at least a locating bolt 233 arranged vertically and correspondingly onto the connecting side 21 of the pivoting seat of operating lever 20 and the assembly side of pivoting seat 12 of the angular adjustment seat 10. The locating bolt 233 is penetrated into the through-holes 231 and then bolted into the locating screw holes 232, so that the pivoting seat of operating lever 20 can shift vertically in an adjustable state within limited stroke.

Based upon above-specified structural design, the present invention is operated as follows.

Figure 5:
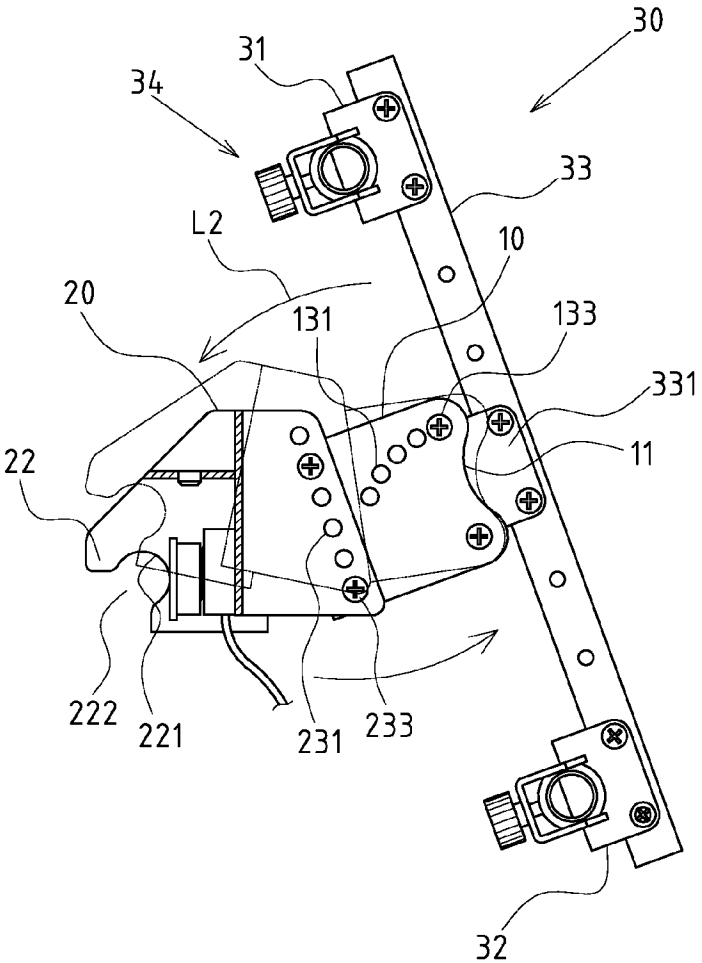
FIG. 5 shows a schematic view of the present invention where the angular adjustment seat is under an angular swinging state.

Referring to FIG. 5, when it is intended to adjust the swinging angle of the angular adjustment seat 10, the fixed through-hole 132 with bolt 133 of the adjuster 13 is taken as a pivotal point, another bolt 133 passes through transverse assembly holes 131 of different angles for angular adjustment and limitation (disclosed by arrow L2). This helps to adjust the direction of the mating side of operating lever 22, and make the guide opening 222 in an outward-dipping state.

Figure 6:
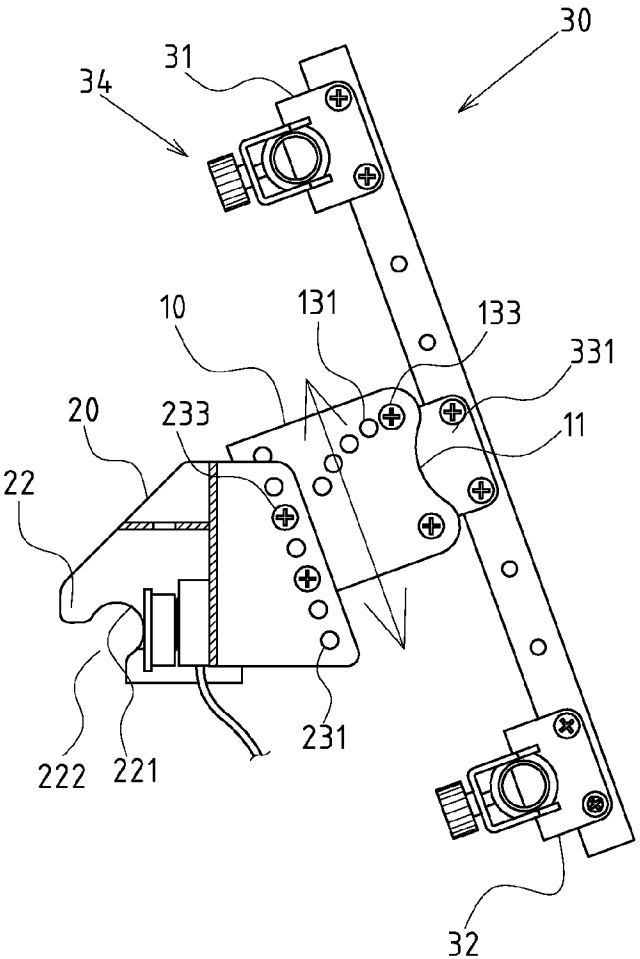
FIG. 6 shows a schematic view of the present invention where the pivoting seat of operating lever shifts in an adjustable state.

Referring to FIG. 6, when the pivoting seat of operating lever 20 is intended for vertical displacement, the pivoting seat of operating lever 20 can be penetrated into the through-holes 231 and then bolted into the locating screw holes 232 via the locating bolt 233 of the limiting portion 23, so that the pivoting seat of operating lever 20 can shift vertically in an adjustable state within limited stroke to adjust its distance from the ground.

When the angular adjustment seat 10 and the pivoting seat of operating lever 20 of the assembly and positioning mechanism allow to adjust the limiting rabbet 221 set for the mating side 22 of the pivoting seat of operating lever 20 for outward-dipping extension with a preset distance from the ground. The snapping rod 014 of the operating lever 01 is embedded into the limiting rabbet 221. So, the operating lever 01 inwardly shifts upwards, and the assembly and positioning mechanism is coupled with the locating rack 30 to drive the front wheel 021 of the wheelchair 02 to be lifted off, enabling to rotate easily the direction of the wheelchair 02 via the auxiliary steering wheel 011 and the rear wheel of the wheelchair.

I claim:

1. An apparatus comprising:

a wheelchair having a carriage;

an operating lever;

a driving rack cooperative with said wheelchair for driving said wheelchair;

a locating rack assembled at a front side of said carriage of said wheelchair, said operating lever being mounted onto said carriage of said wheelchair; and an angular adjustment seat having an assembly side pivotally mounted to said locating rack by an adjuster such that said angular adjustment seat can swing thereabout so as to allow a position of said angular adjustment seat to be controlled, said operating lever having a liftable pivoting seat containing a connecting side and a mating side, said connecting side being aligned with said assembly side of said angular adjustment seat, said pivoting seat of said operating lever being mated with said angular adjustment seat by a limiting portion so as to cause said pivoting seat to be vertically movable, said operating lever having a mating side with a limiting rabbet, said limiting rabbet having a profile, said limiting rabbet having a guide opening extending outwardly.

2. The apparatus of claim 1, said locating rack having an I-shaped profile so as to form an upper cross rod and a lower cross rod and a vertical rod, said vertical rod being fitted with a connecting member having spaced-apart screw holes theron, said adjuster of said angular adjustment seat having a plurality of assembly holes arranged transversely at a top of said assembly side of said angular adjustment seat, said assembly side having a fixed through-hole at a bottom thereof, said plurality of assembly holes and said fixed through-hole receiving bolts respectively therein.

3. The apparatus of claim 2, said locating rack having a retaining seat, said retaining seat having a fixed end and a movable end and a drive member, said drive member controlling a shift of said movable end, said fixed end and said movable end defining a retaining space therebetween.

4. The apparatus of claim 2, said upper and lower cross rods of said locating rack having an inner tube sleeved to an external tube so as to adjustably set a length of said upper and lower cross rods, said upper and lower cross rods being fitted with a tension member.

5. The apparatus of claim 1, said limiting portion having a plurality of through-holes and locating screw holes and at least one bolt arranged vertically and correspondingly onto said connecting side of said pivoting seat of said operating lever and said assembly side of said pivoting seat.

* * * * *